US011344752B2

(12) United States Patent
Sutton et al.

(10) Patent No.: US 11,344,752 B2
(45) Date of Patent: May 31, 2022

(54) SYSTEM AND METHOD FOR MONITORING A SERVICE LIFE OF A FILTER WITH A RESPIRATOR FILTER SAMPLING PORT ASSEMBLY

(71) Applicant: SCOTT TECHNOLOGIES, INC., Boca Raton, FL (US)

(72) Inventors: Robert Charles Sutton, Merseyside (GB); Frank Ding, Charlotte, NC (US); Michael Parham, Weddington, NC (US)

(73) Assignee: Scott Technologies, Inc., Boca Raton, FL (US)

( * ) Notice: Subject to any disclaimer, the term of this patent is extended or adjusted under 35 U.S.C. 154(b) by 975 days.

(21) Appl. No.: 15/311,716

(22) PCT Filed: May 14, 2015

(86) PCT No.: PCT/US2015/030770

§ 371 (c)(1),
(2) Date: Nov. 16, 2016

(87) PCT Pub. No.: WO2015/175777

PCT Pub. Date: Nov. 19, 2015

(65) Prior Publication Data

US 2017/0080261 A1 Mar. 23, 2017

Related U.S. Application Data

(60) Provisional application No. 61/994,306, filed on May 16, 2014.

(51) Int. Cl.
*A62B 9/00* (2006.01)
*A62B 7/10* (2006.01)
(Continued)

(52) U.S. Cl.
CPC ..... *A62B 9/006* (2013.01); *A62B 7/10* (2013.01); *A62B 18/02* (2013.01); *A62B 18/088* (2013.01); *A62B 23/02* (2013.01)

(58) Field of Classification Search
CPC .. A62B 9/00; A62B 9/006; A62B 7/00; A62B 7/10; A62B 18/00; A62B 18/02;
(Continued)

(56) References Cited

U.S. PATENT DOCUMENTS 3,200,387 A * 8/1965 Loscher ..... G01N 30/00 96/417
4,530,706 A * 7/1985 Jones ..... B01D 53/02 55/379
(Continued)

FOREIGN PATENT DOCUMENTS

DE 9407866 U1 * 7/1994 ..... A62B 18/088
DE 9407866 U1 7/1994
(Continued)

OTHER PUBLICATIONS

International Search Report and Written Opinion dated Jul. 28, 2015 for International Application Serial No. PCT/US2015/030770, International Filing Date: May 14, 2015, consisting of 15-pages.

*Primary Examiner* — Kathryn E Ditmer
(74) *Attorney, Agent, or Firm* — Christopher & Weisberg, P.A.

(57) ABSTRACT

A system for monitoring service life of a filter may include a respirator configured to be worn by an individual. The respirator may include a face mask and a filter housing that retains a filter within a filter chamber. A sensor assembly may be configured to monitor gas from the filter chamber. A respirator filter sampling port assembly is configured to adaptively connect the filter housing to the sensor assembly. The respirator filter sampling port assembly may include an
(Continued)

adapter that removably secures to the filter housing, and fluidly couples the filter chamber of the filter housing to the sensor assembly.

8 Claims, 10 Drawing Sheets

(51) Int. Cl.
*A62B 23/02* (2006.01)
*A62B 18/08* (2006.01)
*A62B 18/02* (2006.01)

(58) Field of Classification Search
CPC ..... A62B 18/08; A62B 18/088; A62B 19/00; A62B 19/02; A62B 9/02; A62B 18/10; A62B 23/02; A61M 2205/75; A61M 16/00; A61M 16/0003; A61M 16/0051; A61M 16/021; A61M 16/022; A61M 16/024; A61M 16/06; A61M 16/0841; A61M 16/085; A61M 16/105–107; B01D 46/0086; B01D 46/2411; B01D 46/429; B01D 46/444; B01D 46/448; B01D 46/46; B01D 53/0454
See application file for complete search history.

(56) References Cited

U.S. PATENT DOCUMENTS 5,659,296 A * 8/1997 Debe ..... A62B 18/088 340/632
5,727,498 A * 3/1998 Hackler ..... G01N 31/223 116/206
6,497,756 B1 * 12/2002 Curado ..... B01D 53/0415 128/201.25
2010/0284010 A1 * 11/2010 Duncan ..... A62B 18/088 356/432
2010/0294273 A1 * 11/2010 Rakow ..... A62B 19/00 128/202.22
2012/0161051 A1 * 6/2012 Williams ..... F16L 37/084 251/149
2013/0047982 A1 * 2/2013 Tobias ..... A62B 18/006 128/202.22
2015/0020800 A1 * 1/2015 Tobias ..... A62B 9/006 128/202.22

FOREIGN PATENT DOCUMENTS

WO 9612523 A1 5/1996
WO 2008145988 A1 12/2008
WO WO-2012018766 A2 * 2/2012 ..... B01D 46/0086
WO 2013028981 A2 2/2013

* cited by examiner

SYSTEM AND METHOD FOR MONITORING A SERVICE LIFE OF A FILTER WITH A RESPIRATOR FILTER SAMPLING PORT ASSEMBLY

RELATED APPLICATIONS

This application is a Submission Under 35 U.S.C. § 371 for U.S. National Stage Patent Application of International Application Number: PCT/US2015/030770, filed May 14, 2015 entitled "SYSTEM AND METHOD FOR MONITORING A SERVICE LIFE OF A FILTER WITH A RESPIRATOR FILTER SAMPLING PORT ASSEMBLY," which claims priority to U.S. Provisional Application No. 61/994,306, filed May 16, 2014, the entirety of both which are incorporated herein by reference.

FIELD OF THE DISCLOSURE

Embodiments of the present disclosure generally relate to systems and methods for monitoring service life for a filter of a respirator, and, more particularly, to a respirator sampling port assembly configured to adaptively connect a filter housing of a respirator assembly to a sensor assembly.

BACKGROUND OF THE DISCLOSURE

Air purifying respirators ("APRs"), including powered air purifying respirators ("PAPRs"), include filters that are configured to remove chemical contaminants from air flowing through the respirator and into an airway of an individual wearing the respirator. Known filters prevent or impede the passage of one or more chemical contaminants from the atmosphere surrounding the respirator into the airway of the individual through the filter.

Typically, filters may be used to filter chemical contaminants for a limited time. For example, known filters prevent chemical contaminants from passing therethrough at concentrations above a breakthrough concentration for a service life of the filter. The breakthrough concentration may be an upper safety threshold for inhalation of the contaminants. For example, an individual wearing the respirator may not safely inhale a contaminant at concentrations above the breakthrough concentration without a significant increase in the risk of injury or illness from the contaminant. The service life of a filter may represent a predetermined time period that the filter may be exposed to the contaminants and prevent passage of the contaminants above the breakthrough concentration.

Service lives of filters may be affected by ambient conditions, such as varying temperatures, barometric pressures, humidity, contaminant concentrations, breathing rates, chemical contaminants, and the like. Such ambient conditions may significantly shorten the service life of a filter. If the shortened service life of a filter is not accurately tracked or measured, an individual wearing the respirator faces an increased risk of harm by using a filter after the service life has expired.

In order to monitor changes to the service lives of filters, a change out schedule may be provided that lists how often a filter needs to be replaced when used in certain environments or under certain types of ambient conditions. The service lives provided by the change out schedules are predetermined and may not account for changes to the service lives during use of the filters. For example, the change out schedules may not dynamically adjust the expected service life of a filter when the filter is used in an environment where the ambient conditions may shorten the service lives of the filter during use of the filter.

Another method for monitoring changes to the service lives of filters includes providing end of service life indicators ("ESLI") on or within the filters that are retained within filter cavities. An ESLI includes a meter or other indication device that provides a warning that the filter is about to expire. Known ESLIs may monitor concentrations of contaminants that are filtered by respirator filters and, when the contaminant concentration rises above a threshold, an alarm may be triggered to notify the operator that a filter needs to be replaced.

One known ESLI includes a passive indicator, which is typically non-powered. The passive indicator is configured to undergo a change in physical properties. The physical change may be detected by an end user or a simple detector (for example, a color change, release of odor, heat release, refractive index change, or the like). Another known ESLI includes an active indicator that may have an electronic (power) gas sensor with electronics and indicator (visual, audible, and/or tactile).

However, integrating an ESLI, whether passive or active, into a respirator filter cavity may be costly and difficult, if not impossible. For example, an ESLI may be too large to fit within a filter cavity of a respirator. As such, known respirator filters may not be able to accommodate various ESLIs.

Accordingly, a need exists for a system and method for efficiently monitoring a service life of a filter, such as that of a respirator.

SUMMARY OF THE DISCLOSURE

Certain embodiments of the present disclosure provide a respirator filter sampling port assembly that may include an adapter that is configured to removably secure to a filter housing of a respirator. The adapter may be configured to fluidly connect a filter chamber of the filter housing to a sensor assembly, such as an ESLI. The sensor assembly may be disposed outside of the filter chamber.

In at least one embodiment, the sensor assembly is remotely located from the adapter and the filter housing. The adapter may include an outlet that connects to the sensor assembly through at least one fluid-conveying tube. In at least one other embodiment, the sensor assembly is retained within the adapter. The adapter may be configured to threadably secure to the filter housing.

The adapter may be configured to couple to a fluid passage tube of a filter support that is secured within the filter chamber. For example, the adapter may include a sampling tube that is configured to fluidly couple to a portion of the fluid passage tube. A sealing member may sealingly engage the sampling tube and the fluid passage tube. The sampling tube may include a pointed tip that is configured to puncture a closure within a portion of the fluid passage tube when the adapter is initially secured to the filter housing.

Certain embodiments of the present disclosure provide a system for monitoring service life of a filter. The system may include a respirator configured to be worn by an individual. The respirator may include a face mask and a filter housing that retains a filter within a filter chamber. A sensor assembly is configured to monitor gas from the filter chamber. A respirator filter sampling port assembly is configured to adaptively connect the filter housing to the sensor assembly. The respirator filter sampling port assembly may include an adapter that removably secures to the filter housing. The adapter fluidly couples the filter chamber of the filter housing to the sensor assembly.

Certain embodiments of the present disclosure provide a method for monitoring service life of a filter. The method may include adaptively connecting a filter housing of a respirator to a sensor assembly with a respirator filter sampling port assembly. The adaptively connecting operation may include removably securing an adapter of the respirator filter sampling port assembly to the filter housing. The method may also include fluidly connecting a filter chamber of the filter housing to the sensor assembly through the adaptively connecting operation, and monitoring gas from the filter chamber of the filter housing with the sensor assembly.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

U.S. Pat. No. 7,860,662, entitled "Systems and Methods for Determining Filter Service Lives" to Parham et al., issued Dec. 28, 2010 (the "'662 Patent"), which is hereby incorporated by reference in its entirety, discloses systems and methods for determining service lives of respirator filters. Embodiments of the present disclosure provide sampling filter port assemblies that are configured to deliver fluid within a filter cavity of a respirator to an ESLI, such as disclosed in the '662 Patent.

PCT application No. WO2012/018766, entitled "Method and Apparatus for Integrating Chemical and Environmental Sensors Into an Air Purification Filter Through a Reusable Sensor Post," published Feb. 9, 2012, which is incorporated by reference in its entirety, discloses a sensor device that is configured to provide an end of service life indication for an air purification filter.

Figure 1:
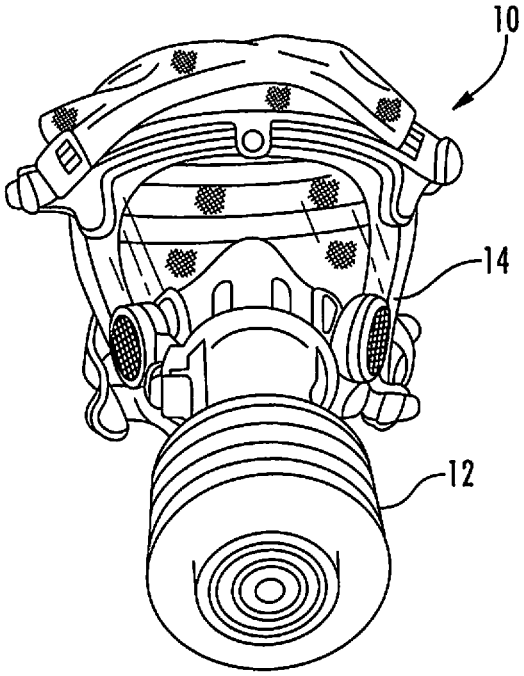
FIG. 1 illustrates a perspective front view of a respirator, according to an embodiment of the present disclosure.
Figure 2:
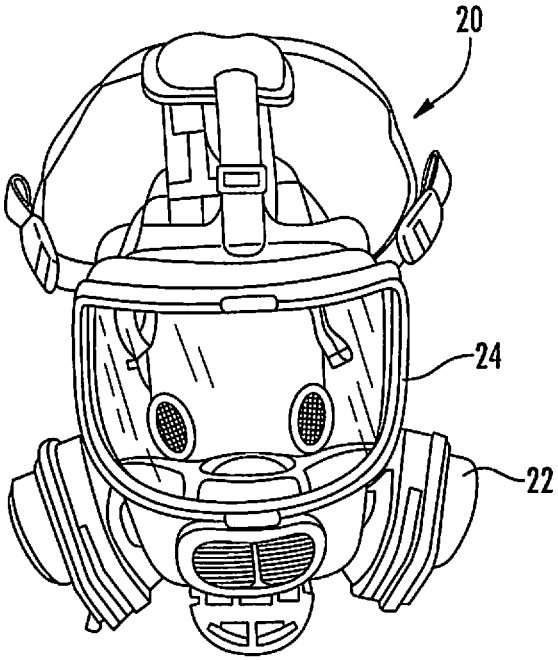
FIG. 2 illustrates a perspective front view of a respirator, according to an embodiment of the present disclosure.

FIGS. 1 and 2 illustrate perspective front views of respirators 10 and 20, respectively, according to embodiments of the present disclosure. The respirators 10 and 20 may each include a filter housing 12 and 22, respectively, that defines an internal cavity that retains a filter. The respirator 10 may be an APR having a full face mask 14, while the respirator 20 may be a PAPR having a full face mask 24. The respirators 10 and 20 are merely examples. Various other respirators having filters may be used with embodiments of the present disclosure. The respirators 10 and 20 may be worn by an individual to filter out chemical contaminants from a flow of air to the individual. For example, the individual breathes air that passes through the filters into the respirators 10 and 20, and into the lungs of the individual. The filters prevent chemical contaminants from being inhaled by the individual.

Figure 3:
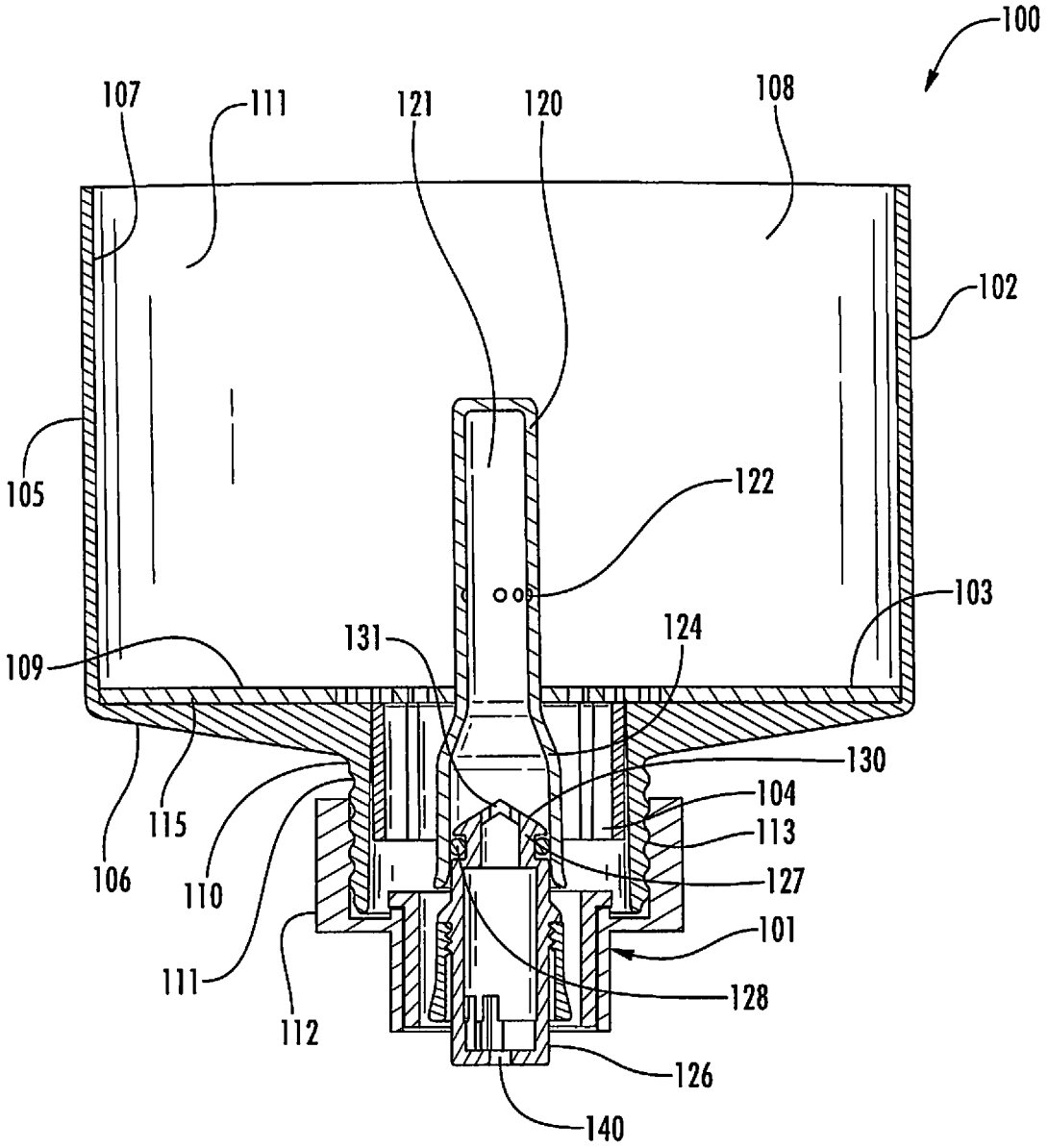
FIG. 3 illustrates an axial cross-sectional view of a system for providing fluid within a filter housing of a respirator to an ESLI, according to an embodiment of the present disclosure.
Figure 4:
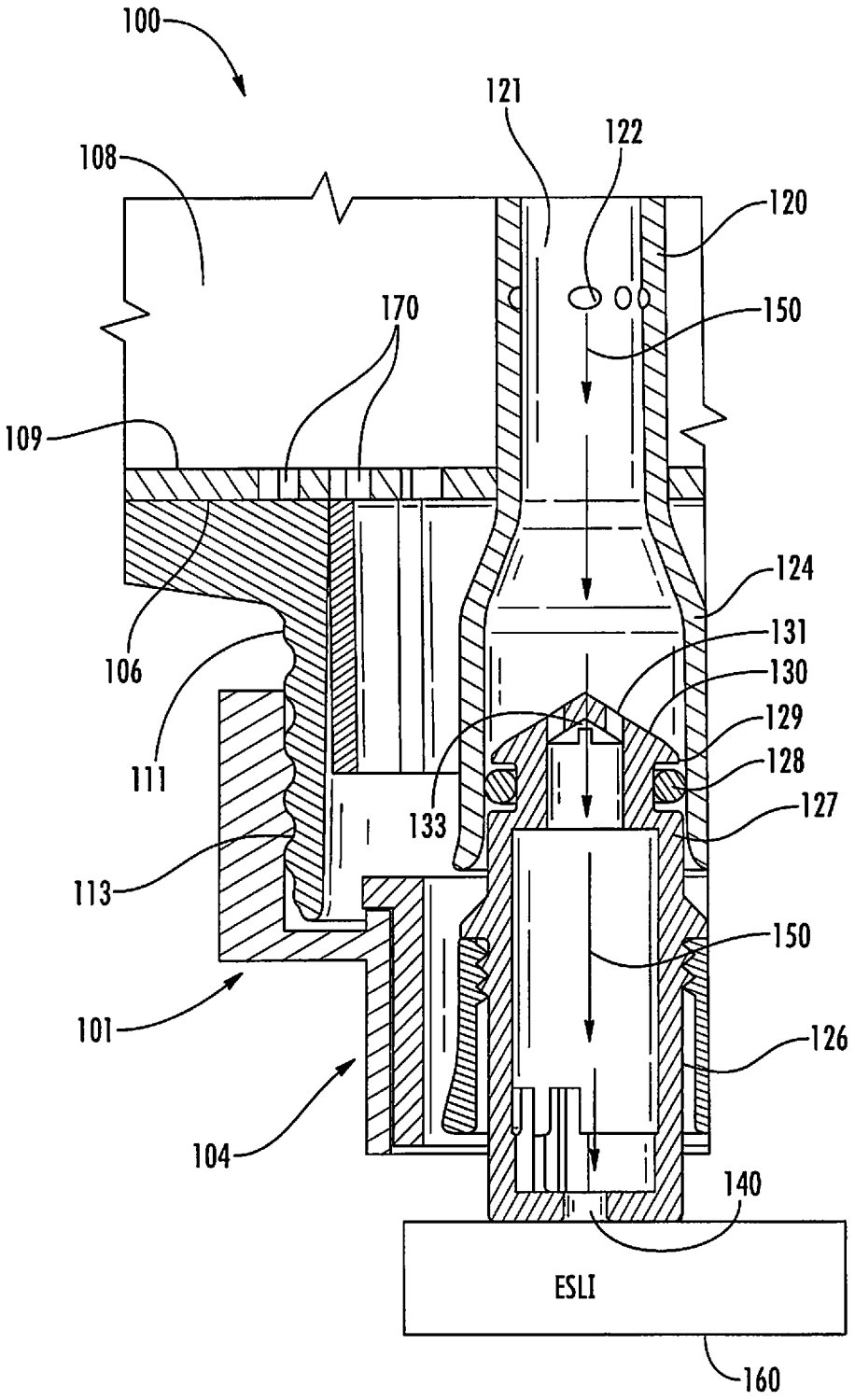
FIG. 4 illustrates a partial axial cross-sectional view of a respirator filter sampling port assembly secured within a filter housing of a respirator, according to an embodiment of the present disclosure.

FIG. 3 illustrates an axial cross-sectional view of a system 100 for providing fluid within a filter housing 102 of a respirator to an ESLI, according to an embodiment of the present disclosure. FIG. 4 illustrates a partial axial cross-sectional view of a respirator filter sampling port assembly 104 secured within the filter housing 102. Referring to FIGS. 3 and 4, the system 100 includes the filter housing 102 and the respirator filter sampling port assembly 104. A filter support 103 may be supported within the filter housing 102 and configured to support a filter within a filter chamber 108.

The filter housing 102 defines an outer wall 105 integrally connected to a support base 106. As shown, the outer wall 105 may be a generally circumferential wall that integrally connects to the support base 106. Also, alternatively, the filter housing 102 may be shaped and sized in a different manner than shown. For example, the filter housing 102 may be formed as a block, instead of a cylindrical structure.

An internal filter chamber or cavity 108 is defined between interior surfaces 107 of the outer wall 105 and an interior surface 109 of the support wall 106. A filter medium 111, such as a filter sorbent bed, which may be or include activated carbon, granulated activated carbon, powered activated carbon, zeolite, and/or the like, is retained within the filter chamber 108.

A fluid channeling member 110, such as a neck, nozzle, or the like, may outwardly extend from an axial center of the support wall 106. Alternatively, the fluid channeling member 110 may outwardly extend from various other locations of the support wall 106. An outer surface 111 of the fluid channeling member 110 may be configured to threadably connect to an adapter 101 (which may include a cap 112), such as that of the filter sampling port assembly 104. For example, the cap 112 may be rotated into a secure engagement with the fluid channeling member 110 through the outer surface 111 threadably engaging a threaded inner surface 113 of the cap 112.

The filter sampling port assembly 104 may provide an adapting component that is configured to operatively couple the filter housing 102 to an ESLI 160. The ESLI 160 may be outside of the filter chamber 108. That is, the ESI 160 may not be secured on or in a filter, or on or in the filter chamber 108. The filter sampling port assembly 104 includes the adapter 101 that is configured to adaptively connect the filter housing 102 to the ESLI 160. Alternatively, the ESLI 160 may be disposed within the adapter 101, but outside of the chamber 108.

The filter sampling port assembly 104 may be threadably secured to the fluid channeling member 110, and may connect to the filter support 103, which may extend through at least a portion of the fluid channeling member 110. For example, the filter support 103 may include a fluid passage tube 120 (which may provide a fluid sampling tube that is configured to allow fluid within the filter chamber 108 to pass therein) having a first portion that extends upwardly into the filter chamber 108 and a second portion that extends into the filter fluid channeling member 110 and fluidly connects to a portion of the adapter 101. The fluid passage tube 120 may be supported in an upright position within the filter chamber 108 by a plurality of support legs 115 that radially extend from a portion of the fluid passage tube 120. The fluid passage tube 120 may extend into and upwardly from a central axial center of the support wall 106. The fluid passage tube 120 may include one or more air passages 122 formed therethrough. The passages 122 are in fluid communication with an internal chamber 121 formed through the fluid passage tube 120. As such, the internal air passages 122 allow fluid to be drawn from the internal filter chamber 108 to the fluid passage tube 120 through the internal chamber 121. More or less air passages 122 than shown may be used. The air passages 122 may be formed at a common level of the fluid passage tube 120. Optionally, the passages 122 may be formed at varying levels of the fluid passage tube 120 to allow gas to be sampled from one or more different levels within the filter chamber 108.

The fluid passage tube 120 may include or otherwise connect to an expanded tubular portion 124 that sealingly secures to the respirator filter sampling port assembly 104. For example, the respirator filter sampling port assembly 104 may include a sampling tube 126, which may include an inner engaging tube 127 that is configured to be mated into the expanded tubular portion 124. The respirator filter sampling port assembly 104 may also include a sealing member 128, such as a gasket or O-ring, that provides a sealing barrier between an outer surface of the inner engaging tube 127, and an inner surface of the expanded tubular portion 124 of the filter support 103. The sealing member 128 may be secured within a notch 129 formed underneath a bottom edge of a tip 131 of the inner engaging tube 127 and above an upper ledge of a main body portion of the inner engaging tube 127.

An upper end 130 of the inner engaging tube 127 may include the pointed tip 131 that is configured to puncture, cut, or otherwise open a closure, such as a foil seal, that may be positioned within the expanded tubular portion 124 of the filter support 103. Air passages are formed proximate to the upper end 130 to allow fluid 150 received from the filter chamber 108 to pass from the fluid passage tube 120, through the inner engaging tube 127, and out through an outlet 140 that may be in fluid communication with an ESLI 160, for example.

As shown, the ESLI 160 may abut directly into the respirator filter sampling port assembly 104. However, it is to be understood that the ESLI 160 may connect to the outlet 140 through tubing that is positioned between the ESLI 160 and the port 140. A pneumatic pump (not shown) may pump sampled gas from the port 140 to the ESLI 160.

Additionally, non-sampled fluid may be directed through the internal chamber 108, through fluid passages 170, and around or otherwise past the inner engaging tube 127. In this manner, a portion of fluid within the internal chamber 108 may be sampled and passed to the ESLI 160, while the remaining portion (for example, the majority) of the fluid passes around the inner engaging tube 126 and out of the respirator filter sampling port assembly 104.

Notably, the ESLI 160 may be coupled to the filter sampling port assembly 104 and positioned outside of the system 100. The ESLI 160 may not be positioned within the filter chamber 108. However, the filter sampling port assembly 104 allows fluid sampled from within the filter chamber 108 to be received and detected by the ESLI 160.

The fluid chamber 108 may be sealed by foil or other such materials to allow use of the filter in non-sampled scenarios. The pointed tip 131 of the inner engaging tube 127 may be used to puncture the seal and not to interfere with non-ESLI filters.

Alternatively, the respirator filter sampling port assembly 104 may not include the inner engaging tube 127. Instead, the fluid passage tube 120 may include a fluid outlet that is in communication with the ESLI. A pump (not shown) may be within the filter sampling port assembly 104, or downstream from the outlet 140. The pump may be used to pump fluid within the filter chamber 108 to the ESLI.

The filter sampling port assembly 104 may contain or otherwise include sensor electronics or remain open to enable connection of a pneumatic connection to a gas detector and pump. The fluid passage tube 120 may be configured to be connected to different locations in the filter bed.

As described above, the filter sampling port assembly 104 may include the cap 112 and the inner engaging tube 127. The inner engaging tube 127 may include the pointed tip 131 that is configured to puncture a seal within the tubular portion 124 of the fluid support 103 to allow fluid within the filter chamber 108 to pass from the filter chamber 108 through the filter support 103 and into the filter sampling port assembly 104. Optionally, the fluid passage tube 120 may be part of the filter sampling port assembly 104. In at least one other embodiment, the fluid passage tube 120 may be part of the filter 111. For example, the fluid passage tube 120 may be integrally connected to the filter 111. Therefore, the filter sampling port assembly 104 may include the inner engaging tube 127 that engages the fluid passage tube 120 of the filter 111, as described above. In this manner, when the filter sampling port assembly 104 is secured to the filter housing 102, the inner engaging tube 127 sealingly mates with the fluid passage tube 120 of the filter 111, which is secured to the filter housing 102.

After the service life of the filter 111 ends, the filter 111 (which may include the fluid passage tube 120) may be removed from the filter chamber 108. A new filter, which may include a different fluid passage tube 120, may replace the discarded filter 111. The same filter sampling port assembly 104, which may threadably secured to the filter housing 102, may be used to sample fluid within the filter chamber 108.

Figure 5:
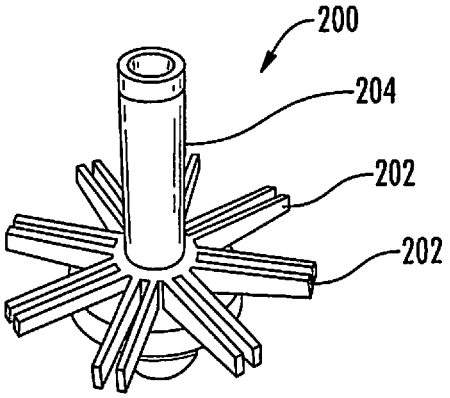
FIG. 5 illustrates a perspective top view of a filter sampling port assembly, according to an embodiment of the present disclosure.

FIG. 5 illustrates a perspective top view of a filter support 200, according to an embodiment of the present disclosure. The filter support 200 may include support legs 202 that radially extend from a base of a sampling tube 204. As noted above, the sampling tube 204 may be a part of a filter. For example, the sampling tube 204 may be molded into a filter and/or a filter housing. The support legs 202 are configured to support the sampling tube 204 in an upright position within a filter chamber.

Figure 6:
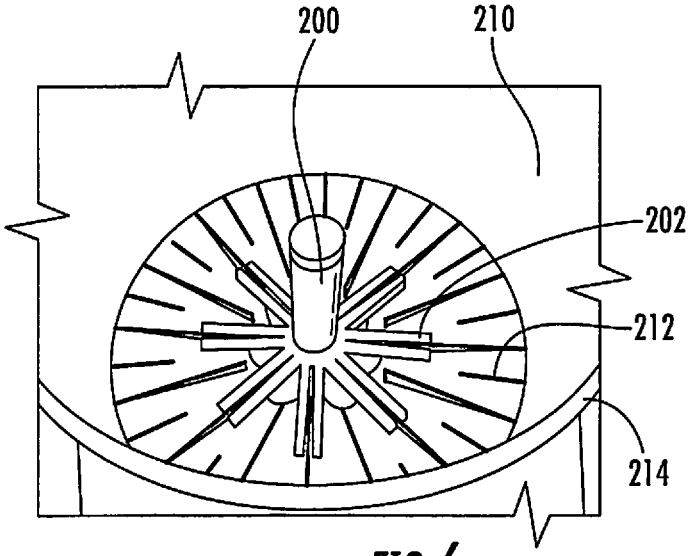
FIG. 6 illustrates a perspective top view of a filter sampling port assembly within a filter chamber, according to an embodiment of the present disclosure.
Figure 7:
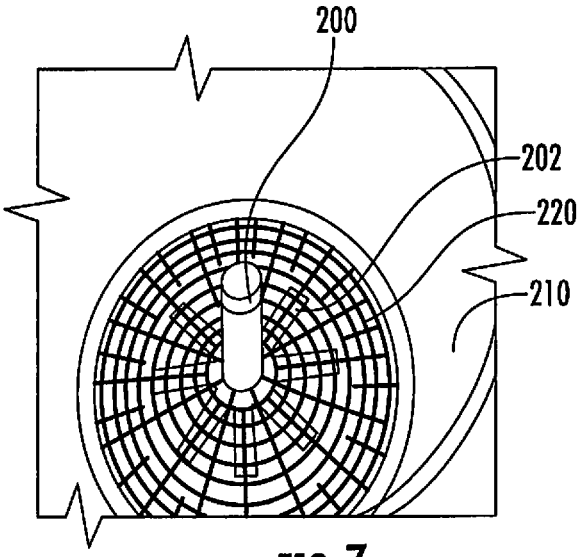
FIG. 7 illustrates a perspective top view of a filter sampling port assembly within a filter chamber and a sorbent bed screen positioned over support legs of the assembly, according to an embodiment of the present disclosure.

FIG. 6 illustrates a perspective top view of the filter support 200 within a filter chamber 210, according to an embodiment of the present disclosure. As shown, the support legs 202 abut into an upper surface of a support wall 212 of the filter housing 214, thereby propping the sampling tube 204 in an upright or normal position with the respect to the support wall 212. FIG. 7 illustrates a perspective top view of the filter support 200 within the filter chamber 210 and a sorbent bed screen 220 positioned over the support legs 202 of the assembly 200, according to an embodiment of the present disclosure.

Figure 8:
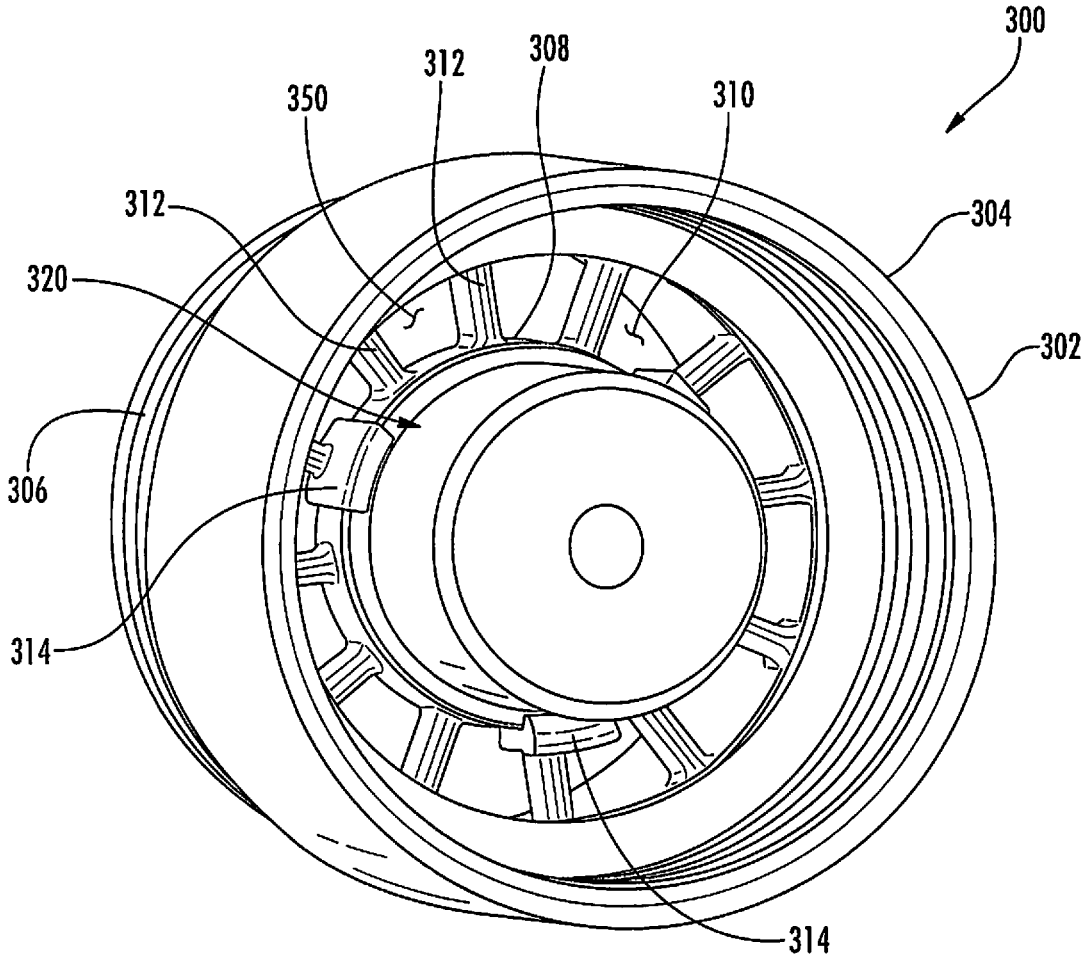
FIG. 8 illustrates a perspective top view of a respirator filter sampling port assembly, according to an embodiment of the present disclosure.

FIG. 8 illustrates a perspective top view of a respirator filter sampling port assembly 300, according to an embodiment of the present disclosure. The respirator filter sampling port assembly 300 may include an adapter 302 having an outer wall 304. The adapter 302 may include a threaded interface 306 that is configured to allow the assembly 300 to be removably secured to a filter housing. The assembly 300 may not include a cap.

An internal support base 308 (which may include a panel, wall, or the like) is positioned within an internal chamber 310 defined by the outer wall 304. The support base 308 may be suspended within the internal chamber 310 through a plurality of radial extension beams 312. One or more sensor fasteners 314, such as clips, hooks, snaps, or the like, secure a sensor assembly 320 to the support base 308. The sensor assembly 320 may include a sensor operatively coupled to circuitry. The sensor assembly 320 may be an ESLI. The adapter 302 may retain the sensor assembly 320. Accordingly, the sensor assembly 320 may be disposed within the adapter 302.

Figure 9:
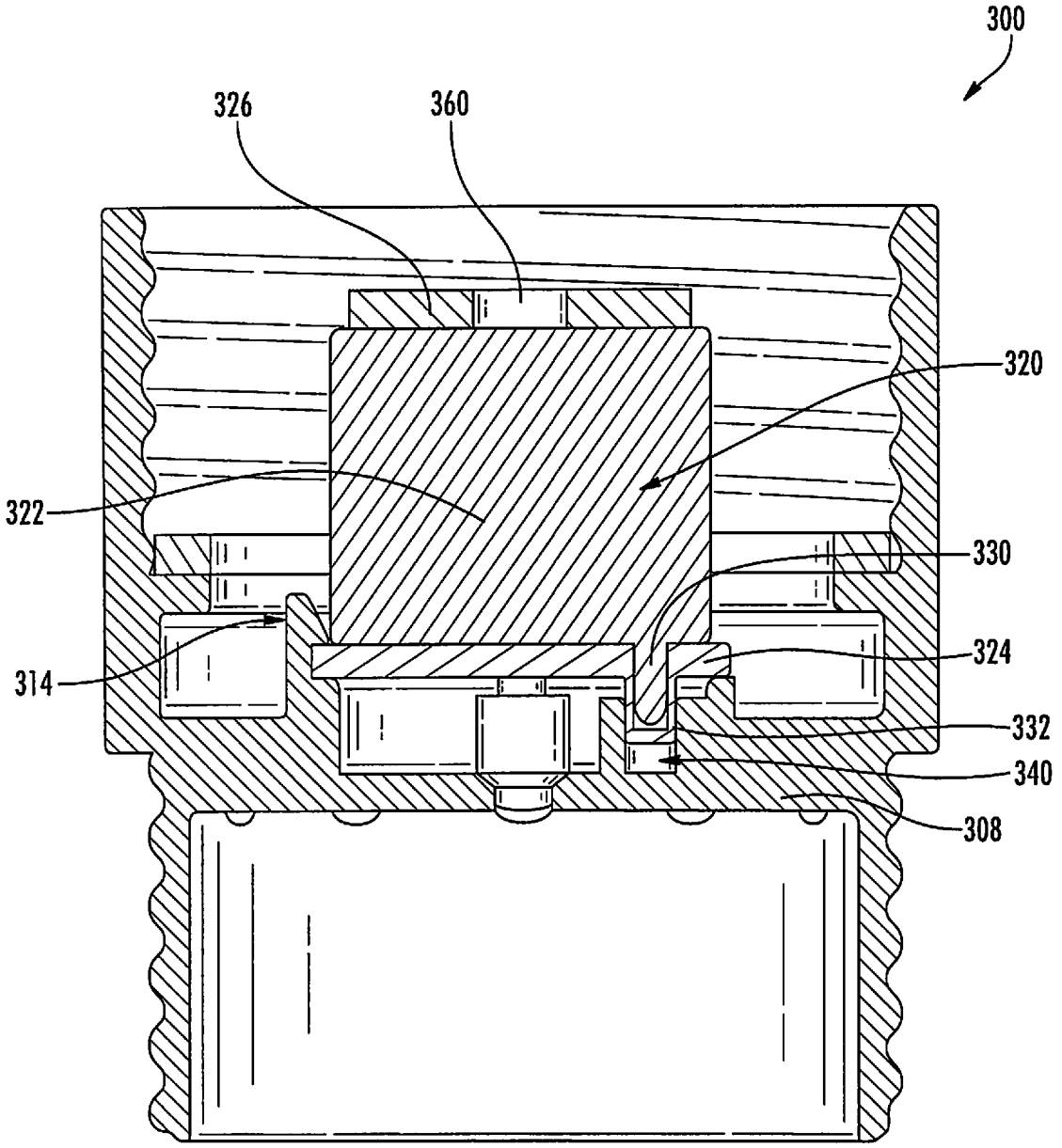
FIG. 9 illustrates an axial cross-sectional view of a respirator filter sampling port assembly, according to an embodiment of the present disclosure.

FIG. 9 illustrates an axial cross-sectional view of the respirator filter sampling port assembly 300, according to an embodiment of the present disclosure. The sensor assembly 320 may include a sensor body 322 operatively coupled to a printed circuit board 324. A gasket 326 may be positioned over the sensor body 322 and aligned with a fluid inlet of the sensor body 322. The sensor assembly 320 may also include retention members 330 and 332 that are configured to securely connect the sensor assembly 320 to one or more cavities 340 formed in the support base 308, thereby preventing the sensor assembly 320 from rotating within the respirator filter sampling port assembly 300.

Referring to FIGS. 8 and 9, fluid may pass through openings 350 formed between the support base 308 and the extension beams 312. Sampled fluid may pass through an opening 360 formed through the gasket and into the inlet of the sensor body 322.

As shown and described, the sensor assembly 320 may be secured within the respirator filter sampling port assembly 300. Notably, the sensor assembly 320 is not disposed within an internal chamber of a filter housing.

Figure 10:
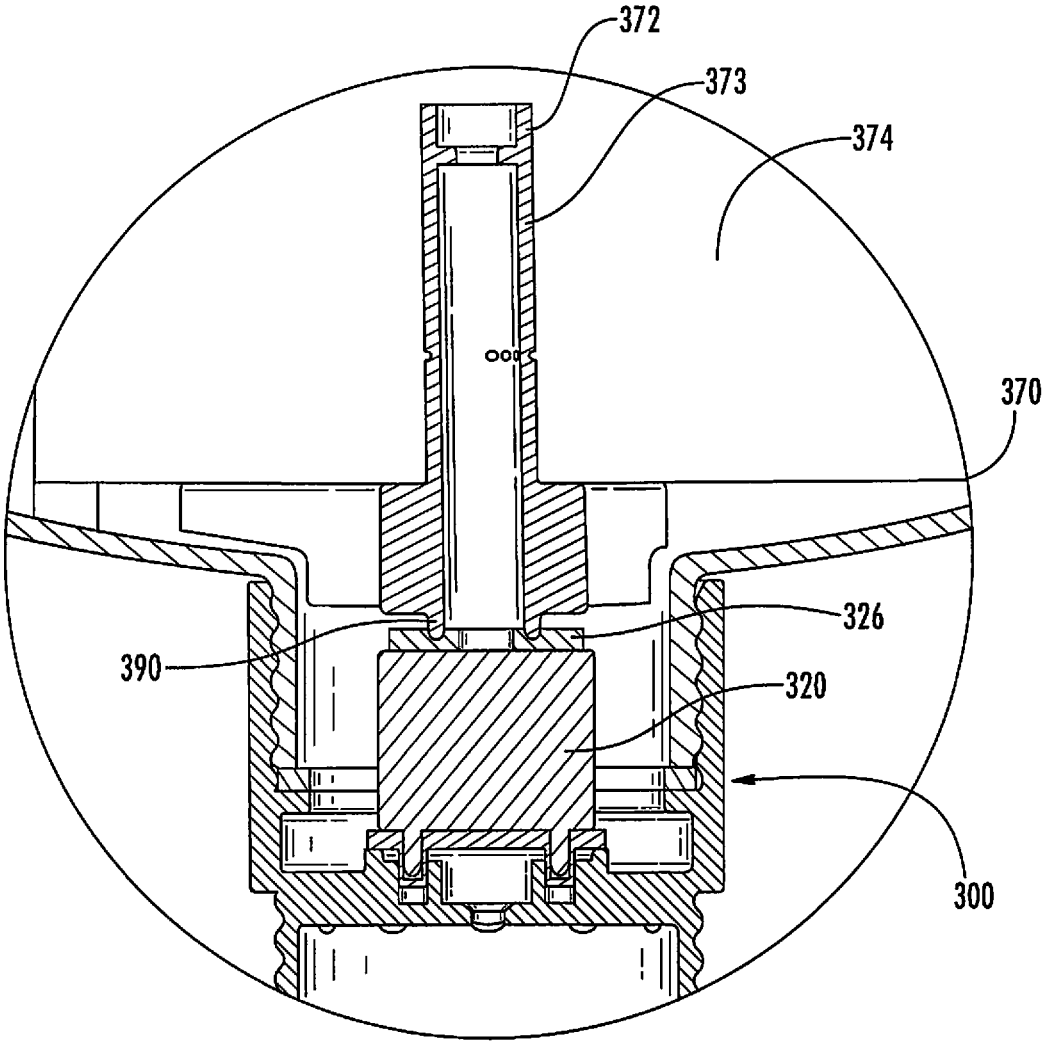
FIG. 10 illustrates an axial cross-sectional view of a respirator filter sampling port assembly secured to a filter housing, according to an embodiment of the present disclosure.

FIG. 10 illustrates an axial cross-sectional view of the respirator filter sampling port assembly 300 secured to a filter housing 370, according to an embodiment of the present disclosure. A filter support 372 may be positioned within a filter chamber 374 of the filter housing 370. The filter support 372 includes a fluid passage tube 373 that fluidly couples to the gasket 326. As such, sampled gas may be drawn from the fluid passage tube 373 and into the sensor assembly 320.

As shown in FIG. 10, the sensor assembly 320 is not disposed within the filter chamber 374. However, by disposing the sensor assembly 320 within the respirator filter sampling port assembly 300, the sensor assembly 320 is positioned closer to the filter chamber 374 as compared to if the sensor assembly 320 was remote therefrom. As such, in the embodiment shown in FIGS. 8-10, sampled gas may be drawn to the sensor assembly 320 without the use of extended tubing, a pump, and/or the like.

The filter support 372 may include protuberances 390 that compress into the gasket 326 when the filter support assembly 300 is securely connected to the filter housing 370. As such, the protuberances 390 may ensure that the gasket 326 remains secured in position when the respirator filter sampling port assembly 300 is secured to the filter housing 370.

As shown and described, the respirator filter sampling port assembly 300 may secure to the filter housing 370 through a threadable connection. Optionally, the respirator filter sampling port assembly 300 may secure to the filter housing 370 through various other connection interfaces, such as latches, snaps, separate and distinct fasteners (e.g., pins securing into reciprocal openings), and the like.

Figure 11:
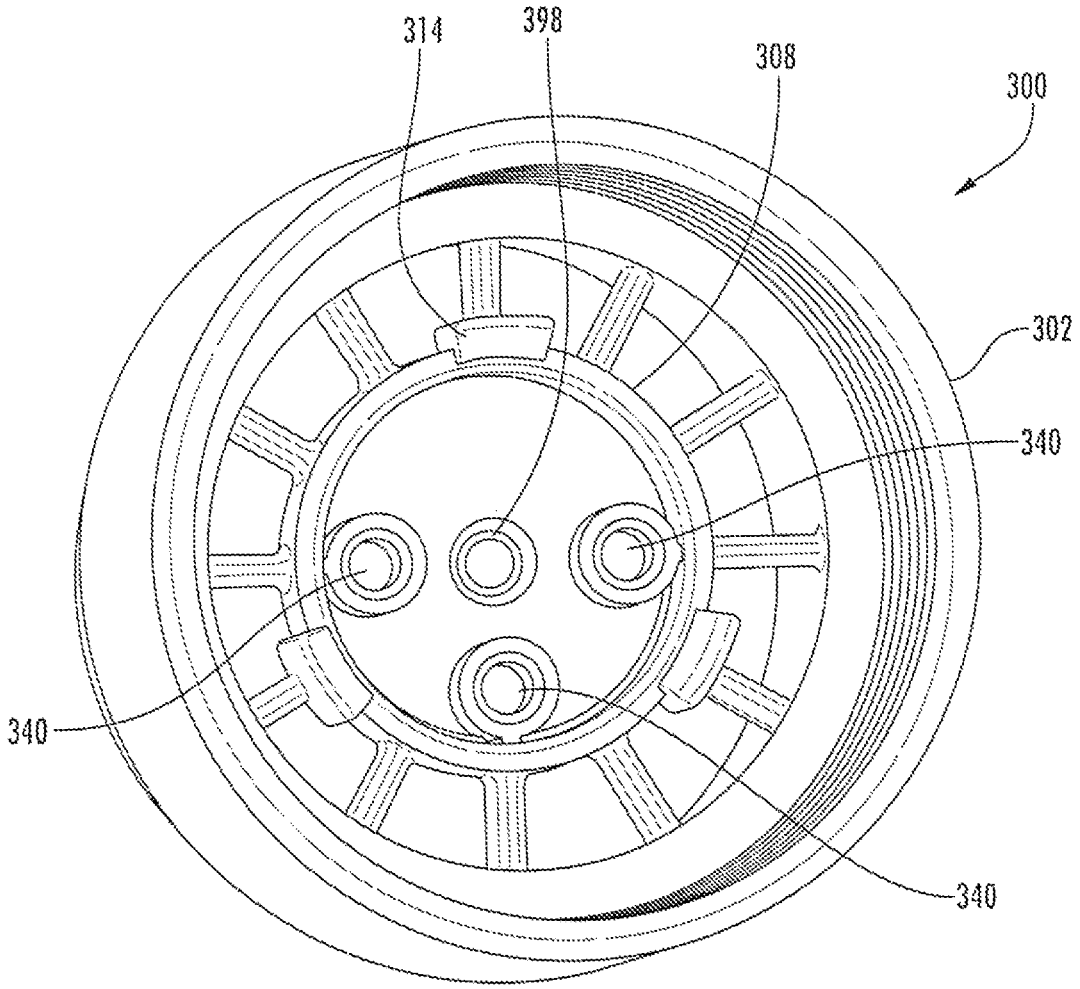
FIG. 11 illustrates a perspective top view of a main body of a respirator filter sampling port assembly, according to an embodiment of the present disclosure.

FIG. 11 illustrates a perspective top view of the adapter 302 of the respirator filter sampling port assembly 300, according to an embodiment of the present disclosure. The sensor assembly 320 and the gasket 326 are not shown in FIG. 11. The support base 308 may include three retaining cavities 340. Optionally, more or less retaining cavities 340 may be used to retain a corresponding number of retention members of the sensor assembly 320. Also, the support base 308 may include three fasteners 314, spaced around a circumference thereof. Alternatively, the support base 308 may include more or less fasteners 314 than shown.

A central cable passage 398 may be formed through the support base 308. The central cable passage 398 is configured to allow cables, wires, or the like, to connect to the sensor assembly 320, for example.

Figure 12:
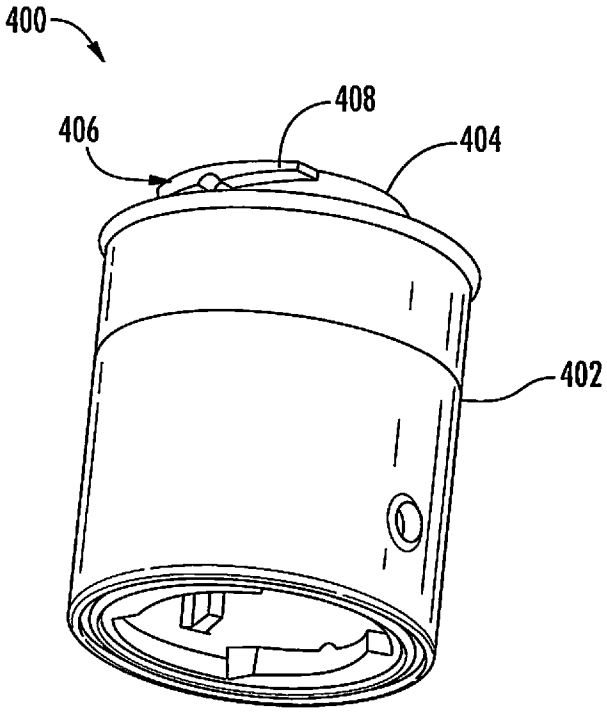
FIG. 12 illustrates a perspective front view of a respirator filter sampling port assembly, according to an embodiment of the present disclosure.

FIG. 12 illustrates a perspective front view of a respirator filter sampling port assembly 400, according to an embodiment of the present disclosure. The respirator filter sampling port assembly 400 includes an adapter 402. A filter engaging end 404 may include a mating interface 406 that is configured to mate with a portion of a filter housing. For example, the mating interface 406 may include a radially extending protuberance 408, such as a bayonet, that is configured to securely connect the adapter 402 to the filter housing.

Figure 13:
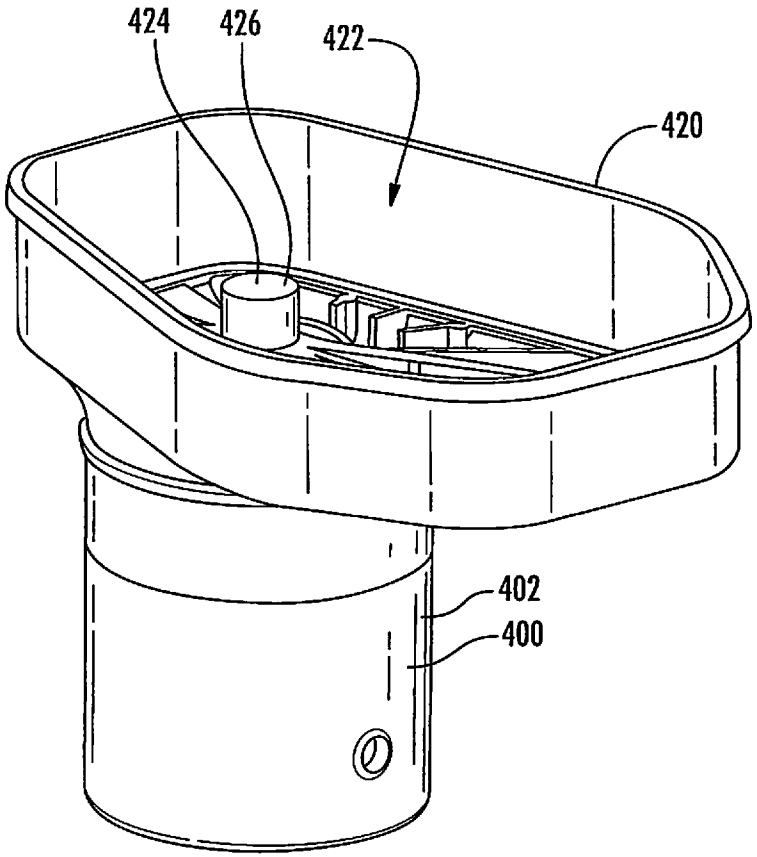
FIG. 13 illustrates a perspective front view of a respirator filter sampling port assembly secured to a filter housing, according to an embodiment of the present disclosure.

FIG. 13 illustrates a perspective front view of the respirator filter sampling port assembly 400 secured to a filter housing 420, according to an embodiment of the present disclosure. The filter housing 420 defines a filter chamber 422. A filter support 424 having a fluid passage tube 426, similar to those described above, may be secured within the filter chamber. The adapter 402 securely connects to the filter housing 420, such as through the mating interface 406 engaging a reciprocal mating interface of the filter housing 420.

Figure 14:
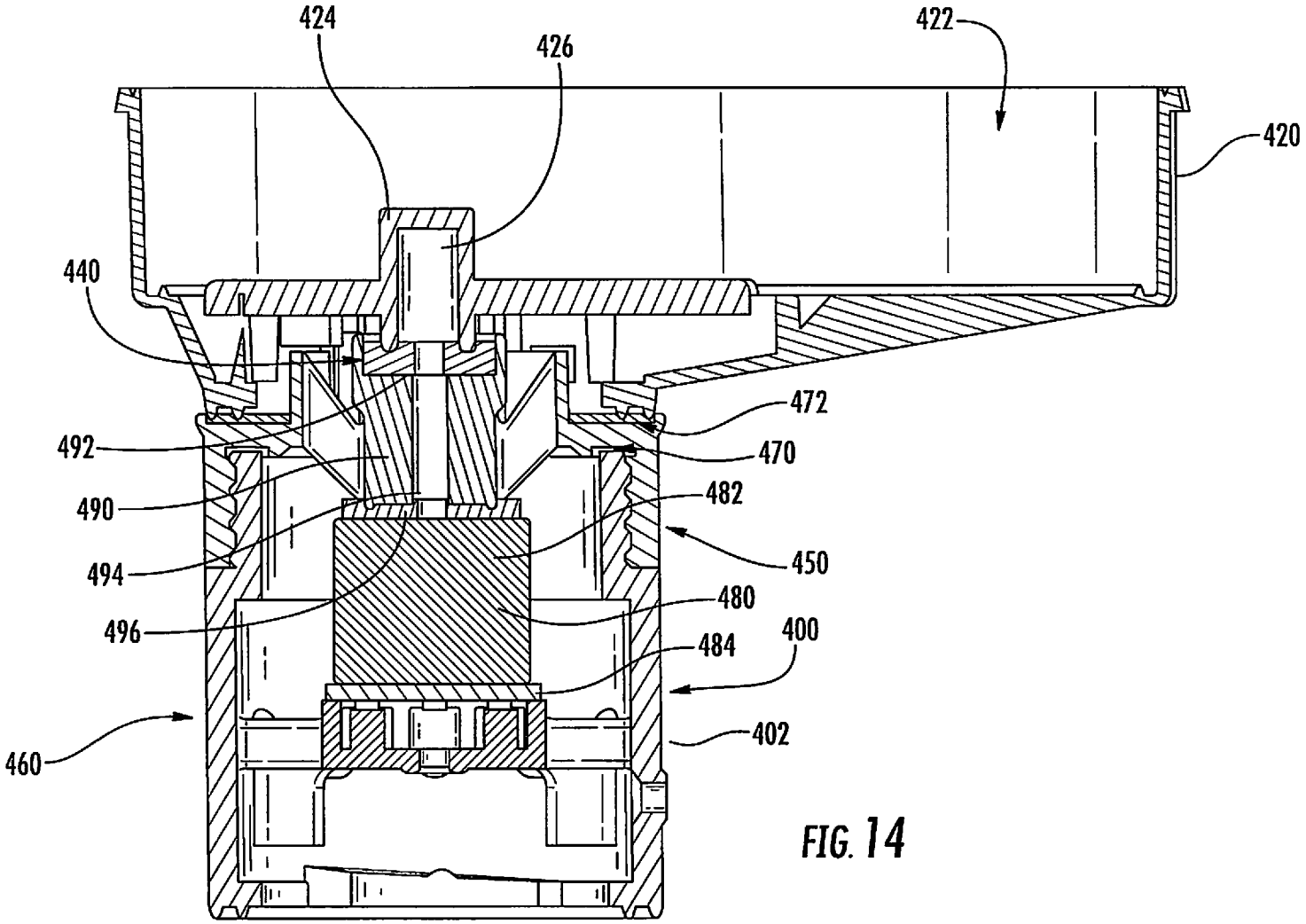
FIG. 14 illustrates an axial cross-sectional view of a respirator filter sampling port assembly secured to a filter housing, according to an embodiment of the present disclosure.

FIG. 14 illustrates an axial cross-sectional view of the respirator filter sampling port assembly 400 secured to the filter housing 420, according to an embodiment of the present disclosure. A gasket 440 may be compressed between an inlet of the adapter 402 and the fluid passage tube 426 of the filter support 424.

The adapter 402 may include a filter connecting housing 450 that removably secures to a sensor retaining housing 460. The filter connecting housing 450 may threadably secure to the sensor retaining housing 460. A sealing member 470 may be disposed between connection interfaces of the filter connecting housing 450 and the sensor retaining housing 460. Additionally, a sealing member 472 may be disposed between connection interfaces of the filter connecting housing 450 and the filter housing 420.

The sensor retaining housing 460 may retain a sensor assembly 480, which may be include a sensor body 482 operatively coupled to a printed circuit board 484, as described above. The filter connecting housing 450 may include a fluid connection tube 490 that is configured to channel sampled fluid from an inlet 492 to an outlet 494 that is in communication with the sensor body 482. A gasket 496 may be compressed between the fluid connection tube 490 and the sensor body 482.

The filter connecting housing 450 may be secured to the filter housing 420. The sensor retaining housing 460 may then be secured to the filter connecting housing 450. Optionally, the sensor retaining housing 460 may first be connected to the filter connecting housing 450, which may then be secured to the filter housing 420. Because the adapter 402 may include the two housings, the sensor retaining housing 460 may be removed from the filter connecting housing 450 so that the sensor assembly 480 may be serviced or replaced, for example. Alternatively, the filter connecting housing 450 and the sensor retaining housing 460 may be integrated into a unitary, indivisible piece.

Referring to FIGS. 1-14, in operation, a filter may be positioned within a filter housing. The respirator filter sampling port assembly may be operatively coupled to the filter housing and in communication with a sensor assembly. During use, the filter may retain various contaminants from an environment. At a certain point, the sensor assembly may indicate that the filter should be changed. As such, the filter may be changed and another clean filter may be placed within the filter housing. Notably, the same respirator filter sampling port assembly may be used. That is, instead of replacing a filter and a sensor embedded within the filter or filter housing, only the filter needs to be replaced. In this manner, embodiments of the present disclosure provide systems and methods that may be used with a variety of filters, instead of a single filter and sensor combination, for example. Embodiments of the present disclosure provide a versatile system and method for monitoring a filter. Moreover, because only the filter needs to be replaced, embodiments of the present disclosure provide economical systems and methods that reduce replacement costs.

Embodiments of the present disclosure also provide other advantages over existing systems and methods. The systems and methods may be used in various environments. Filters that may be adapted for particular environments may be used with embodiments of the present disclosure, as the embodiments of the present disclosure provide versatile filter monitoring systems and methods.

For example, embodiments of the present disclosure may be used with respect to environments in which carbon monoxide may be present. A filter specifically designed to filter carbon monoxide may be used and monitored. The systems may then be used in a different environment in which another gas other than carbon monoxide may be present. The carbon monoxide filter may be removed, and a different filter that is specifically designed to filter the other gas may be placed within the filter housing.

As described above, embodiments of the present disclosure provide a respirator filter sampling port assembly that may include an adapter or housing having an outer surface, a longitudinal cavity, and at least one opening along the outer surface. A sampling port is configured to convey fluid (such as through pneumatic conveyance). The sampling port may be positioned within the longitudinal cavity adjacent to the at least one opening. A connection, such as a pneumatic connection, may be used to convey the fluid to a gas detector. A pump may be used to move the fluid from the sampling port to the gas detector. The housing and/or the sampling port may be removably insertable into a cavity of a filter element. A sensor assembly, such as an ESLI, may be remote from the respirator filter assembly and connected through tubing, for example. Optionally, a sensor assembly may be housed within a portion of the respirator filter assembly.

Embodiments of the present disclosure may be used with a variety of different respirator types. The gas detector may be a simple point detector in which the air inlet holes formed in the sampling port are positioned to enable accurate indication. Various types of gas detectors may be used, such as described in the '662 Patent.

Embodiments of the present disclosure provide a respirator filter sampling port assembly that is configured to adaptively connect a sensor assembly, such as an ESLI, to a filter housing. The sensor assembly is positioned outside of a filter chamber of the filter housing. The filter sampling port assembly delivers sampled fluid from within the filter chamber to the sensor assembly, which may otherwise not be able to fit within a filter chamber. Accordingly, the fluid is sampled directly from within the filter chamber, as opposed to at an outlet of the filter chamber.

The filter sampling port assembly may be used with various types of filters. The filter sampling port assembly is not limited to use with a single filter. As such, embodiments of the present disclosure provide a versatile filter sampling port assembly that may be used with a variety of filters and a variety of filter housings and respirators. In this manner, a respirator is not confined to use with a single filter and sampling port assembly.

Further, embodiments of the present disclosure reduce costs. For example, certain known filters include integral sampling ports. As such, when a filter was replaced, the entire assembly, including the filter and the sampling port, was discarded. However, embodiments of the present disclosure provide a filter sampling port assembly that may be used repeatedly. Instead, of discarding the filter sampling port assembly, a filter medium may be discarded, and a new filter medium may be operatively coupled to the same filter sampling port assembly.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A respirator filter device, comprising:

a respirator filter sampling port assembly comprising a fluid passage tube having a tubular portion, the fluid passage tube having at least one internal air passage that allows fluid to be drawn from within a filter housing of the respirator filter device into the fluid passage tube, the tubular portion being offset from and in fluid communication with the at least one internal air passage of the fluid passage tube, the respirator filter sampling port assembly being fixed within an adapter that is configured to removably secure to the filter housing; and the tubular portion configured to receive a sampling tube, the tubular portion comprising a closure positioned within the tubular portion that is configured to be punctured by the sampling tube; and a sealing member configured to sealingly engage an outer wall of the sampling tube and an inner wall of the tubular portion.

2. The respirator filter device of claim 1, wherein a sensor assembly is retained within the adapter.

3. The respirator filter device of claim 1, wherein the adapter is configured to threadably secure to the filter housing.

4. The respirator filter device of claim 1 wherein the sampling tube includes a notch formed thereon, and wherein the sealing member is secured within the notch.

5. A system for monitoring service life of a filter, the system comprising:

a respirator configured to be worn by an individual, the respirator comprising a face mask and a filter housing that retains a filter within a filter chamber;

a sensor assembly configured to monitor gas from the filter chamber;

a respirator filter sampling port assembly configured to adaptively connect the filter housing to the sensor assembly, the respirator filter sampling port assembly having a tubular portion and being fixed within an adapter that is configured to removably secure to the filter housing, the adapter fluidly coupling the filter chamber of the filter housing to the sensor assembly, the tubular portion configured to receive a sampling tube of an end of life indicator, the tubular portion comprising a closure positioned within the tubular portion that is configured to be punctured by the sampling tube; and a sealing member configured to sealingly engage an outer wall of the sampling tube and an inner wall of the tubular portion.

6. The system of claim 5, wherein the adapter is configured to threadably secure to the filter housing.

7. A method for monitoring service life of a filter, the method comprising:

adaptively connecting a filter housing of a respirator to a sensor assembly with a respirator filter sampling port assembly, the respirator filter sampling port assembly having a tubular portion and being fixed within an adapter that is configured to removably secure to the filter housing and the adaptively connecting operation comprising removably securing the adapter of the respirator filter sampling port assembly to the filter housing by receiving a sampling tube within the tubular portion, the tubular portion comprising a closure positioned within the tubular portion that is configured to be punctured by the sampling tube;

fluidly connecting a filter chamber of the filter housing to the sensor assembly through the adaptively connecting operation;

monitoring gas from the filter chamber of the filter housing with the sensor assembly; and sealingly engaging an outer wall of the sampling tube and an inner wall of the tubular portion with a sealing member.

8. The method of claim 7, further comprising retaining the sensor assembly within the adapter.

* * * * *